United States Patent [19]

Kato

[11] 4,007,501

[45] Feb. 15, 1977

[54] BED HAVING A BED PAN

[75] Inventor: Mikio Kato, Tokyo, Japan

[73] Assignee: Nippon Felt Co., Ltd., Tokyo, Japan

[22] Filed: Aug. 15, 1975

[21] Appl. No.: 605,015

[52] U.S. Cl. ..... 5/90; 4/110

[51] Int. Cl.[2] ..... A61G 7/02

[58] Field of Search ..... 5/90, 91, 10, 11; 4/110, 112

[56] References Cited

UNITED STATES PATENTS

| | | | |
|---|---|---|---|
| 1,945,081 | 1/1934 | Ryan et al. | 5/90 |
| 2,872,689 | 2/1959 | Fournet | 5/90 |
| 3,146,469 | 9/1964 | Slade | 5/91 |
| 3,757,355 | 9/1973 | Allen et al. | 5/90 |
| 3,886,610 | 6/1975 | Shelden | 5/91 |
| 3,887,951 | 6/1975 | Yates et al. | 5/90 |

*Primary Examiner*—Casmir A. Nunberg
*Attorney, Agent, or Firm*—Whittemore, Hulbert & Belknap

[57] ABSTRACT

A bed for a patient having a bed pan mounting recess bored at its central position wherein a bed pan is supported at a level in conformity with a degree of depression of the periphery of said recess such that the buttocks of a patient never strongly touch the pan seat. The bed pan has a hollow front cover which broadly covers around an excretory organ, and only the periphery of said front cover comes into intimate contact with the skin of the patient ranging from the groins up to the lower abdomen whereby the pan seat and the front cover are disposed so as to interpose the body of the patient therebetween.

9 Claims, 41 Drawing Figures

FIG. 34
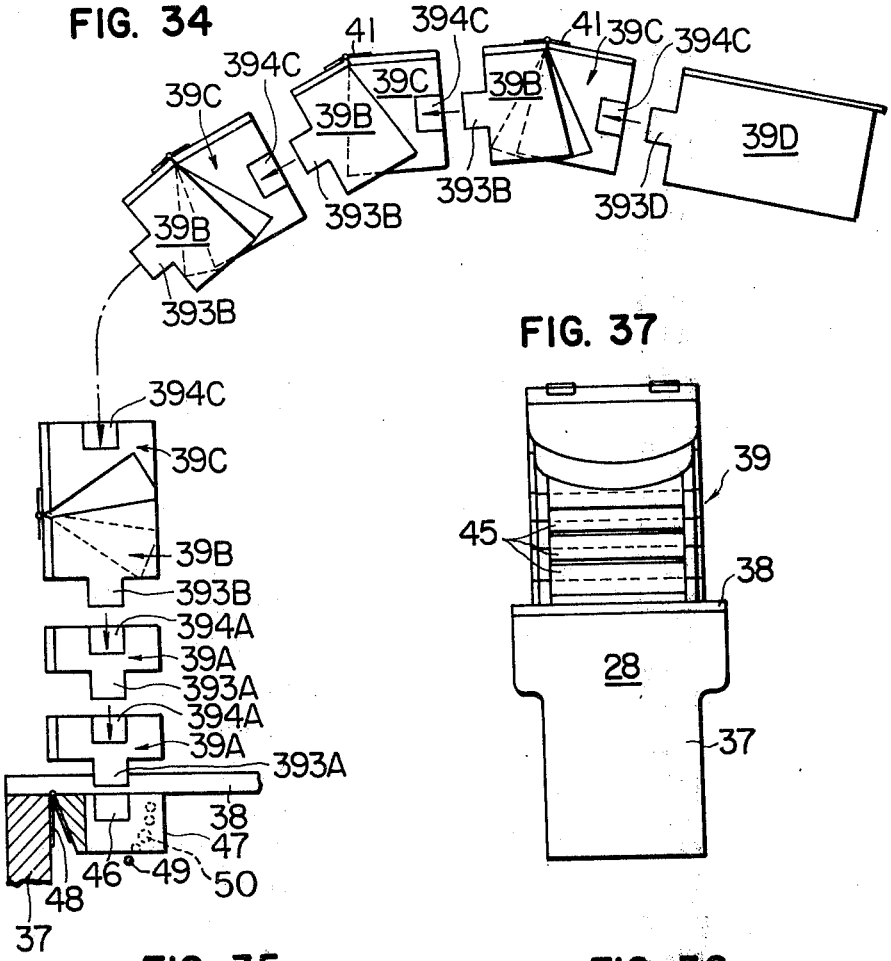
FIG. 37
FIG. 35
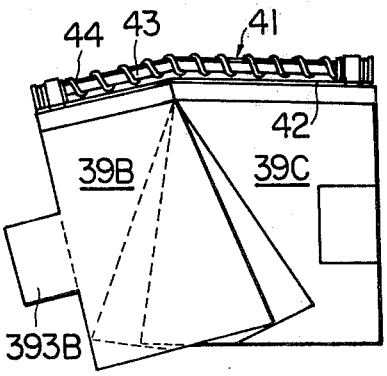
FIG. 36
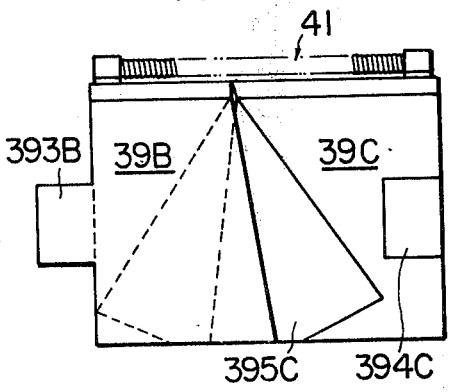

BED HAVING A BED PAN

BACKGROUND OF THE INVENTION

Conventionally, infirm or physically unmovable patients lying down on a bed have an extreme difficulty everyday in excretion. It is a customary practice to put a diaper, a filth pan and like means directly to the body of the patients in order to permit them to excrete while lying down on the bed. The conventional method, however, not only deprives the patients of their freedom, but also cause stuffiness and roughness of the skin, and in addition, this is not at all pleasing for them.

Various beds have therefore been proposed so far which incorporate a bed pan therein. For example, DT-PS 811295 teaches a bed for a patient wherein a bed pan is inserted to the central position of the bed from therebelow, and DT-PS 1270220 likewise discloses a device for inserting a bed pan from the bed and supporting the same at a predetermined position. Since the bed pan is always kept at a predetermined height in these known beds for a patient, however, the patient oftentimes encounters with problems arising from maladjustment of the bed pan depending upon the physique of the patient. For this reason, various arrangements are required from the viewpoint of human engineering such as by adapting an elastic matter along the periphery of the bed pan. Furthermore, means should also be provided to prevent dispersion of excretion to the front of the body.

SUMMARY OF THE INVENTION

This invention relates to a bed for a patient having a bed pan. More particularly, the present invention relates to a bed for a patient having a bed pan which is equipped with a pan seat and a front cover to interpose the body of the patient therebetween without pressing the excretory organ and skin of the patient ranging from the groins up to the lower abdomen.

It is an object of the present invention to provide a bed for a patient having a bed pan of which front cover encompasses the excretory organ of the patient so as to never allow the leakage of excretion.

It is another object of the invention to provide a bed pan which, when mounted to the bed for a patient, is supported at a level of height such that the pan seat becomes nearest the buttocks of the patient, but does not touch therewith strongly in order to thereby eliminate pains of the patient who is obliged to excrete while lying down on the bed.

It is a further object of the invention to provide a bed for a patient having a bed pan wherein a length of a bed pan mounting recess is determined in a lateral direction so that the buttocks of the patient contacting the periphery thereof fall down to a level in the proximity of the lower surface of the mattress.

It is still a further object of the invention to provide a bed for a patient having a bed pan equipped with a hollow front cover only of which periphery comes into mild contact with the skin of the patient ranging from the groins up to the lower abdomen.

It is still a further object of the invention to provide a bed for a patient having a bed pan wherein the bed pan incorporates a hollow front cover comprising a plurality of connectable and separable blocks which are adjustable in accordance with the physique of a patient.

These and other objects of this invention are directed primarily to allow continent, incontinent or inform patients to excrete pleasingly everyday free from any pains or offensive feeling.

For a better understanding of the present invention as well as other objects and features thereof, reference is to be had to the following detailed description of the invention to be read in connection with the accompanying drawings.

BRIEF DESCRIPTION OF THE DRAWINGS

FIG. 34 is an exploded side view showing an embodiment wherein the first through the fourth blocks shown in FIG. 17 through 33 are fitted to the one with the other;

FIG. 35 is a side view showing a second embodiment of a mode of connection between the second and third blocks;

FIG. 36 is a side view showing a third embodiment of a mode of connection between the second and third blocks;

FIG. 37 is a front view of the bed pan to which the front cover is fitted;

DETAILED DESCRIPTION OF PREFERRED EMBODIMENTS:

The present invention will now be explained in further detail with reference to the accompanying drawings.

Figure 1:
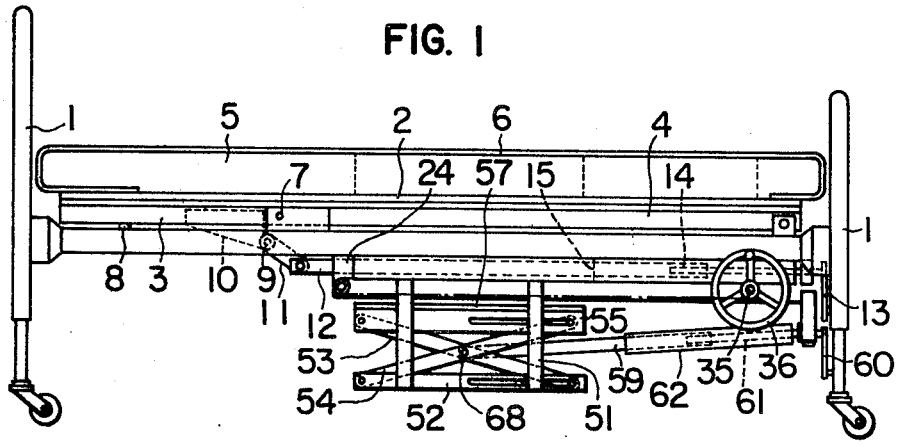
FIG. 1 is a side view of a bed for a patient in accordance with an embodiment of this invention.
Figure 2:
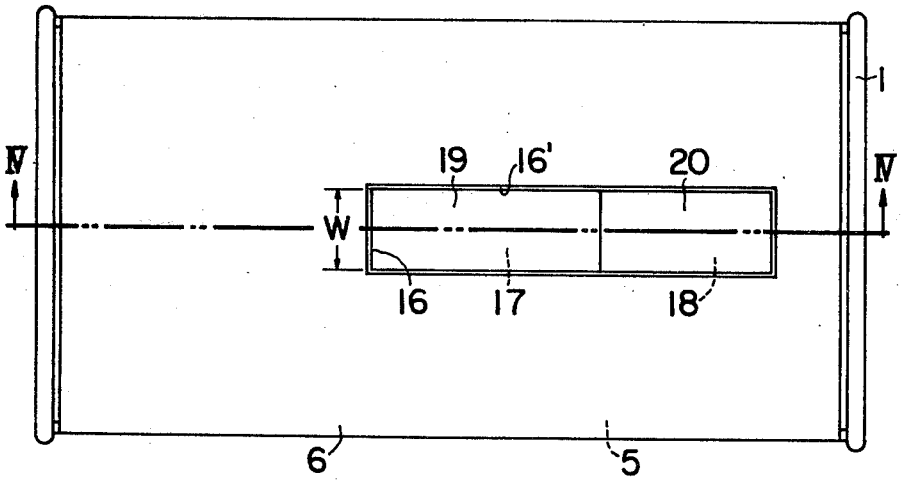
FIG. 2 is also a side view of the bed for a patient shown in FIG. 1 wherein a bed pan mounting recess is closed up by two supplementary mattresses that are divided into the front and rear sections.
Figure 3:
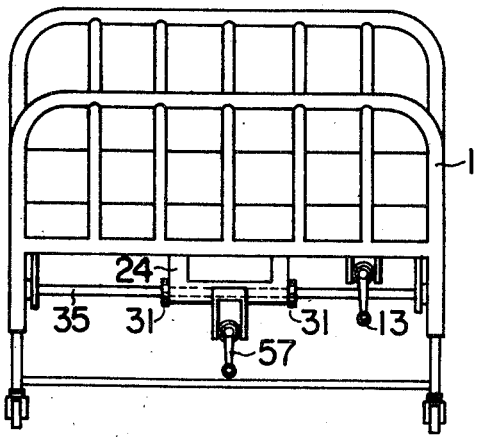
FIG. 3 is a side view of the bed for a patient shown in FIG. 1 when viewed from the side of legs of the bed.

Referring initially to FIG. 1, there are represented a bed frame of the bed by the reference numeral 1, and a mattress support by 2 which is divided into an upper half support section 3 and a lower half support section 4. Onto this mattress support 2 is placed a mattress 5 for the bed made principally of an polyurethane elastomer, and a thin complementary mattress 6 of a needle felt is further put on the mattress 5.

The abovementioned upper half support section 3 constituting the front section of the mattress support 2 is supported pivotally to the bed frame 1 at the side of the lower half support section 4 constituting the rear section of the bed so that it can be inclined in a vertical direction with respect to the bed frame 1. For this purpose, a pin 7 supports the upper half support section 3 as its supporting point. In order to keep the support section 3 horizontal on the frame 1 in a normal condition, a receptacle 8 is provided to the lower surface of the support section 3 at the side of its free end. The bed frame 1 has further a shaft 9 secured thereto at a position below said pin 7, said shaft supporting levers 10 and 11 pivotally. The free end of one of the levers 10 is secured to the upper half support section 3.

A connection rod 12 is screwed to a screw axis 14 which is freely turnable mannually by manupilating a handle 13, and rotation of said rod is positively restrained by the screw axis 14. The connection rod 12 is connected to the free end of the other lever 11. A pipe 15 covers the base section of the connection rod 12 and the screw axis 14.

At the central position of the mattress 5 and the complementary mattress 6 placed on the lower half support section 4, there is defined a rectangular recess 16 for fitting a bed pan in a vertical direction with its longer sides extending along two longer sides of the bed in a longitudinal direction. Under a normal condition, a front supplementary mattress 17 and a rear supplementary mattress 18 are fitted into this recess 16. The length W of the shorter sides of the recess 16 is determined such that when buttocks of a patient is placed onto the recess, the buttocks contacting the periphery 16′ of the recess almost reach the lower lever line of the mattress 5.

When a mattress of a thickness of 100 mm and a recovery rate of 94% is used, for example, the length W of the shorter sides of the recess 16 is most properly 180 mm assuming that a weight of a patient is about 50 – 70 kg. If the length W is longer than 180 mm in this case, the buttocks fall deep into the recess 16 and contact directly the seat of the bed pan. On the contrary, if the length is shorter than 180 mm, the buttocks do not enter into the recess sufficiently whereby positioning of the buttocks becomes unstable during excretion. The length W naturally involves certain variations depending on the size of a patient. In short, therefore, it is necessary to set up the recess in conformity with a size of a patient so that his buttocks contacting the periphery 16′ of the recess 16 may be placed into the recess up to the proximity of the lower level of the mattress 5. In other words, the buttocks should be placed into the recess to such an extent that they do not directly and strongly reach the seat of the pan during excretion.

Complementary mattresses 19 and 20 each having a same thickness and same interior construction with those of the complementary mattress 6 are mounted onto the aforementioned supplementary mattresses 17 and 18 by means of a velvet fastener or a like means detachably. The front and rear supplementary mattresses 17 and 18 have the same interior construction with that of the mattress 5, but the thickness only of the rear supplementary mattress 18 is a little thinner than that of the mattress 5.

Figure 4:
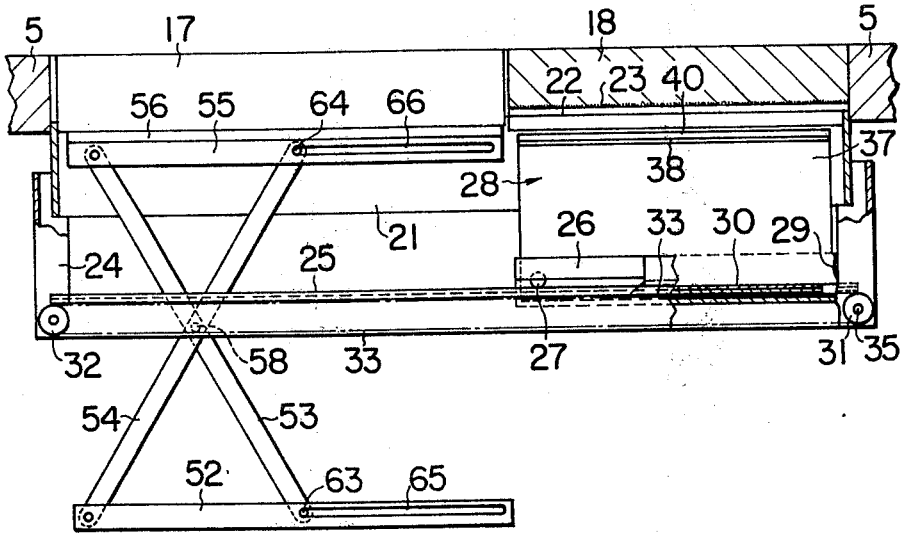
FIG. 4 is a partially vertical sectional side view of the bed for a patient taken substantially along the line IV — IV of the bed pan mounting recess shown in FIG. 2 to show the waiting position of the bed pan shown in FIG. 2.

A support plate 22 for the rear supplementary mattress is positioned on the rear section of a wooden frame 21 which is assembled at the lower part of the rectangular recess 16 for fitting the bed pan. As shown in FIG. 4, the upper surface of the rear supplementary mattress 18 is maintained at a same level with those of the mattress 5 and the front supplementary mattress 17 by this support plate 22. Additionally, a velvet fastener 23 is provided at the upper surface of the support plate 22 for the rear supplementary mattress 18 so as to prevent its movement.

Beneath the bed frame 1, a frame 24 of a bed pan transfer mechanism is stably suspended in a horizontal direction in such a manner as to encompass the periphery of the wooden frame 21. Grooved rails 25 and 25 are disposed at the lower portion of the frame 24 in its longitudinal direction symmetrically with each other onto which a bed pan truck 26 is mounted movably. A wheel of a known ball bearing-type is used in this embodiment for the truck 26. The truck 26 has an aperture defined on its upper surface for fitting the bed pan from above as will hereinafter be described. One or a plurality of thin plates 30 are laid in advance in this aperture 29 before the bed pan 28 is fitted thereinto. The number of the thin plates 30 are adjusted properly in match with a weight of a patient and a degree of falling of the periphery of the recess 16 to support the bed pan 28 to such a critical level that the buttocks of the patient neither contact the seat of the bed pan directly and intimately, nor come off apart therefrom considerably in any event.

Sprockets 31 and 32 are disposed at the positions of the suspension frame 24 symmetrical with each other as shown in FIG. 4, and an endless chain 33 is mounted onto these sprockets. A pin 34 is provided at the lower part of the bed pan truck 26 projecting upward, and engages with a part of said endless chain 33. To rotate the sprocket 31 positively, a shaft 35 projects from the suspension frame 24 symmetrically to the right and left, and a mannual handle 36 is secured to eigher of the projecting ends of said shaft 35.

The bed pan 28 is made of a plastic by molding, and comprises a tank 37 shaped out in box form, a seat 38 put on said tank and a front cover 39 which is bendable and covers broadly around an excretory organ of a patient in intimate contact with the skin ranging from the groin up to the lower abdomen. A lid 40 is detachable to and from the seat 38 when the front cover 39 is removed.

Figure 38:
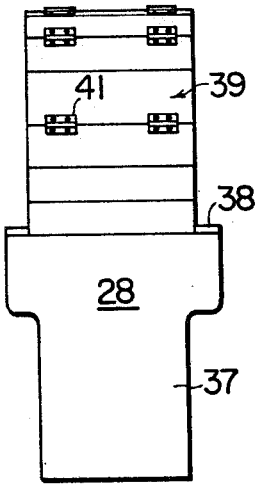
FIG. 38 is a rear view of the bed pan shown in FIG. 37.
Figure 39:
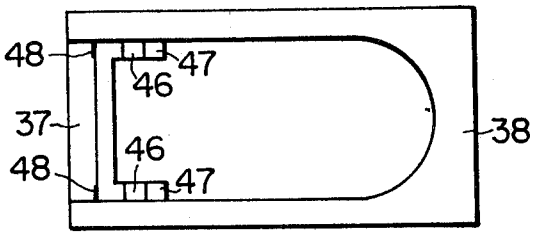
FIG. 39 is a plan view of the bed pan from which the front cover is detached.
Figure 40:
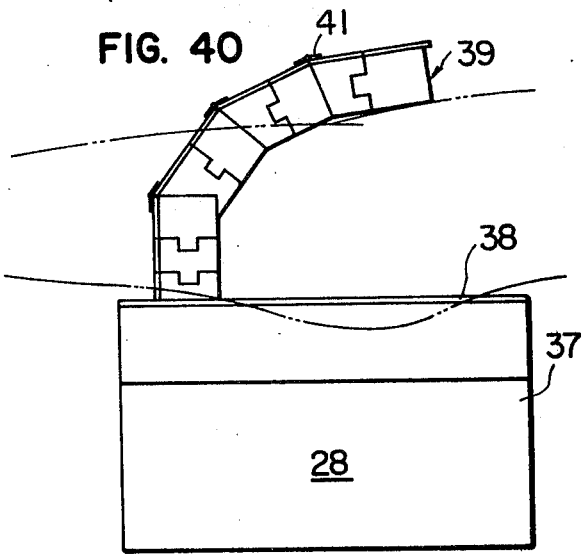
FIG. 40 is a side view showing the bed pan in use.
Figure 41:
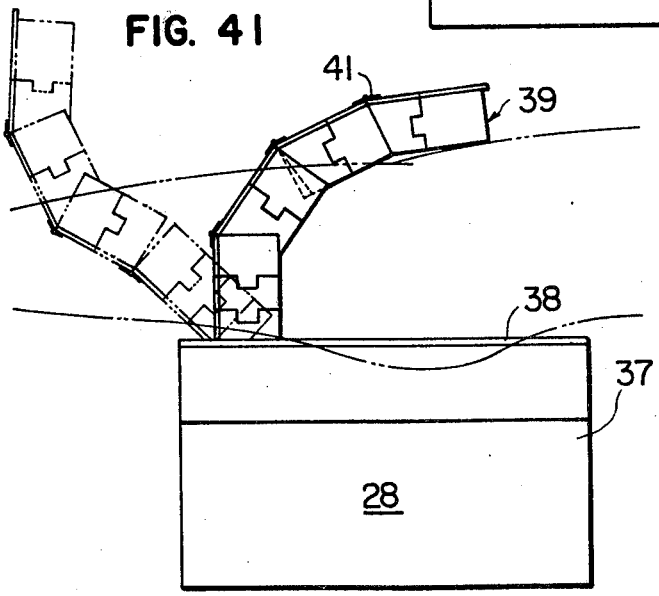
FIG. 41 is a side view wherein the front cover is inclined toward the legs of the bed.

Next, the construction of the bed pan 28 is explained in greater detail with reference to FIGS. 37, 38 and 39.

The box-like tank 37 has a flange projecting from the right and left at its upper part symmetrically for the ease of portability, and the seat 38 to be put thereon is fastened to the tank 37 by proper means so that it does not slip off therefrom easily. The seat 38 has a U-shaped hollow at its central portion, and the surfaces of the seat 38 and the periphery of the hollow are finished to be flat.

The front cover 39 consists of four types of blocks 39A, 39B, 39C and 39D which are connectable and separable freely, each of said blocks being formed in the manner to be described.

FIGS. 17 through 20 illustrate the first block 39A which composes the rising section of the front cover 39. As is evident from these FIGS., the first block consists primarily of rectangular right and left wall pieces 391A, 391A and a ⊐-shaped back plate 392A secured to the back of the wall pieces whereby the distance between the right and left wall pieces 391A, 391A is determined in accordance with a width of a palm of an adult. The wall piece 391A has a rectangular convex piece 393A at its lower surface, and a concave section 394A of a same shape with that of the convex piece right thereabove at is upper surface.

Both the lateral width Wa of the convex piece 393A and the lateral width Wb of the concave section 394A are half the thickness of the wall piece 391A of the first block 39A. However, the longitudinal width and height (depth) thereof are to be at choice properly; namely, several first blocks 39A are laid up in match with the physique of a patient so that when they are connected with each other, they are prevented from sliding in a lateral direction or slipping out from the connecting section 393A, 394A accidentally.

FIGS. 21 through 24 illustrate the second block 39B to be connected to the first block 39A while FIGS. 25 through 29 illustrate the third block 39C which is connected to the second block 39B always bendably. In the like manner as in the first block 39A, both the second and third blocks 39B and 39C have, respectively, the right and left wall pieces 391B, 391B and 391C, 391C, and the back plates 392B and 392C.

Further, the second block 39B has a convex piece 393B of a same size and shape with that of the convex piece 393A of the first block 39A at the lower surface of the right and left wall pieces 391B. Likewise the third block 39C has a concave section 394C at the upper surface of the right and left wall piece 391C, said concave section 394C having a same shape and size with that of the concave section 394A formed on the upper surface of the first block 39A.

As shown in FIGS. 34, 35 and 36, the back plate 392B of the second block 39B is connected to the back plate 392C of the third block 39C by means of a connection member 41.

The connection member 41 shown in FIG. 34 is a hinge which connects the upper section of the back plate 392B of the second block 39B to the lower section of the back plate 392C of the third block 39C so that they are rotatable in the direction of the front and rear. The connection member shown in FIG. 35 comprises the combination of a celluloid plate 42, a lead rod 43 and a steel plate 44 that are assembled integrally in the form of a universal scale, while the one shown in FIG. 36 is of a flexible metallic conduit type which is made up by bending thin plates such as of steel, aluminum and the like in a specific crosssectional shape and combining the resulting products together in a coily shape. In either case, the connection member 41 allows the back plates to rotate in the direction of the front and rear similarly.

When the connection member 41 either of the universal scale type or of the flexible metallic conduit type is used, the connection member is not deformed unless external force is applied thereto so that the angle of the connecting section between the second and third blocks 39B and 39C can be set optionally regardless of the contacting condition of the wall pieces 391B and 391C.

Generally, however, fittings 395B, 395C are defined by cutting off the thickness of the inside surface of the right and left wall pieces 391B of the second block 39B as well as the outside surface of the right and left wall pieces 391C of the third block 39C to the half of their original thickness in order to permit them to properly move mutually. This arrangement eliminates an accidental movement of the connection angle between the second and third blocks 39B and 39C, and also prevents accidental leakage of excretion from the connecting section.

A proper number of the connected bodies, each being composed of the second and third blocks 39B, 39C disposed in the abovementioned construction, are connected with each other and aligned on the first block 39A. Onto the third block 39C at the uppermost position is disposed the fourth block 39D of which end plane is encompassed by the curved wall piece 391D.

As shown in FIGS. 30 through 33, the fourth block 39D has the curved wall piece 391D, both the right and left edge planes of which have the convex pieces 393D, 393D to engage with the concave sections 394C, 394C formed on the right and left wall pieces 391C, 391C of the third block 39C in the like manner as the aforementioned 393A, 393B and 393C. The fourth block 39D also has a cover plate 392D which corresponds to the back plates 392A, 392B and 392C of the first, second and third blocks 39A, 39B and 39C, respectively.

The hollow front cover including the abovementioned first through fourth blocks 39A, 39B, 39C and 39D that are connected with each other is ordinarily made of a transparent plastic, and has, on the internal surface of each connecting section, a cover plate in order to prevent leakage and ensure smooth flow of excretion. A cover sheet is disposed so as to cover the periphery of the wall pieces 391A, 391B, 391C and 391D of all the blocks which come into contact with the skin of a patient directly, said cover sheet being made of a rubber or a water-repellent sponge rubber having a U-shaped cross-section or a properly elastic material having a resiliency but not an excessively strong restoring force. Alternatively, a slit may be defined on the edge plane (i.e. the plane contacting with the skin) of each wall piece of the first through fourth blocks, into which said slit a reversed T-shape covering rubber is fitted.

The reference numeral 46 represents a concave section which allows the front cover 39 to be fitted to the tank 37 detachably, and has a same size and shape with that of the convex piece 393A formed on the lower surface of the first block 39A. A base board 47 having this concave section 46 on its upper surface is adapted to the upper part of the tank 37 by means of a hinge 48 so that it is inclinable to the front and rear.

The base board 47 incorporates a compression spring (not shown) at each end on the right and left, and a ball 49 therein retractably. A plurality of hemispherical concaves 50 are bored on a circle described with the central shaft of the hinge 48 of the right and left inside surfaces of the tank 37 as its center so that any one of said semispherical concaves notches and engages with the ball 49 in order to thereby set the base board 47 at a desired angle firmly.

In accordance with a first embodiment of the present invention, there is provided, on the suspension frame 24, in the like manner as in the bed pan transfer mechanism, a supplementary mattress mechanism for moving the aforementioned front supplementary mattress 17 vertically relative to the bed pan and its transfer mechanism, as will be described in detail in the following paragraphs.

Turning now back to FIG. 1, an auxiliary frame 51 is suspended from the suspension frame 24 further therebelow, and a fixed frame 52 is disposed horizontally below the auxiliary frame 51. A movable frame 55 is disposed above and in parallel with the fixed frame 51 by links 53 and 54 which are connected with each other crisscross diagonally. Altogether, these members 52 through 55 compose a parallel crank mechanism. Onto the upper surface of the movable frame 55 is placed a support plate 56 for the front supplementary mattress, and a velvet fastener 57 is fitted to the upper surface of said support plate 56 to prevent movement of the front supplementary mattress 17.

The X-shaped crossing section 58 of the parallel crank mechanism is connected to an operation mechanism 59 - 62 which has the same construction with that of the elevation mechanism 12 - 15 for the upper half support section 3 of the mattress support 2 that has been explained earlier in this specification. Namely, when a handle 60 is rotated clockwise, the connection rod 59 extends to the left in FIG. 1 by means of the screw axis 61 whereupon the links 53 and 54 start rising. Simultaneously, the movable frame 55 first passes through the inside of the suspension frame 24, and then starts rising. When the movable frame has risen to a maximum, it lifts the front supplementary mattress up to a level equal to the level of the mattress 5. The reference numerals 63 and 64 indicate pins adapted to the movable end of the links 53 and 54, and laterally long holes 65 and 66 guide these pins on either the fixed frame 52 or the movable frame 55.

Next, the mode of usage of the abovementioned first embodiment will be explained with respect to the case of an incontinent patient (serious patient) and the case of a continent patient (mild patient).

Figure 6:
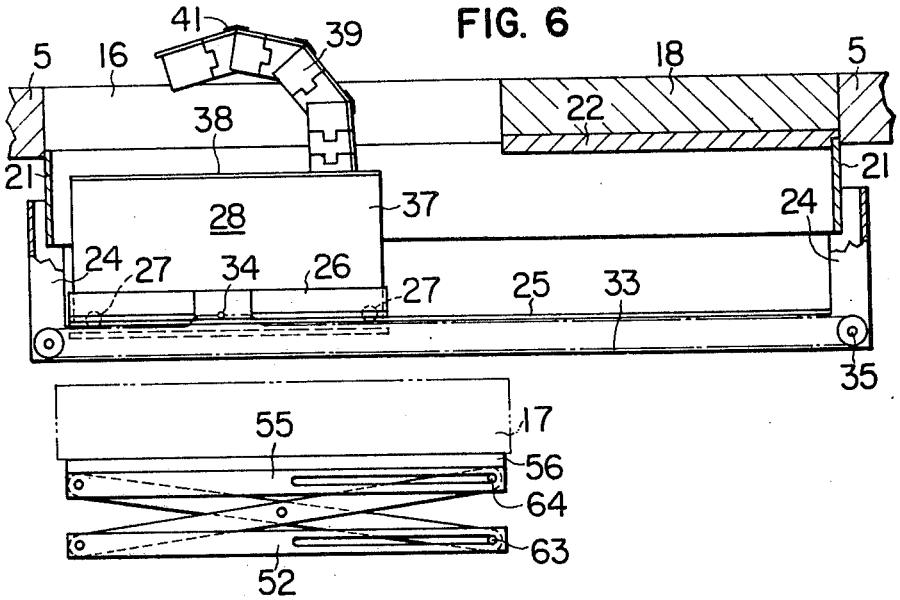
FIG. 6 is also a partially vertical sectional side view of the bed for a patient to show the bed pan in use.
Figure 7:
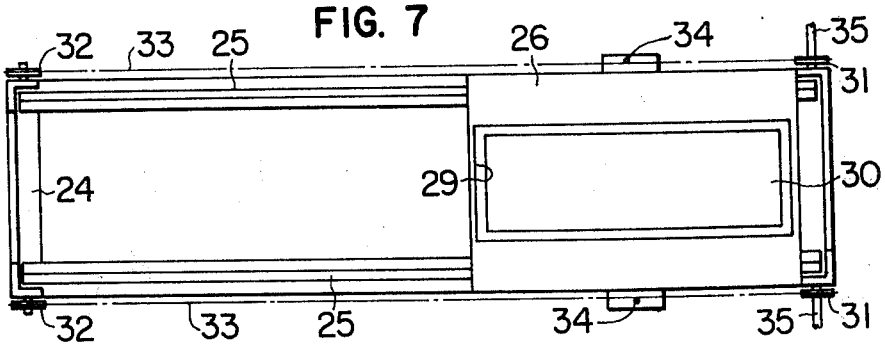
FIG. 7 is a plan view showing a truck for moving a bed pan seat in a lateral direction together with its transfer mechanism.
Figure 8:
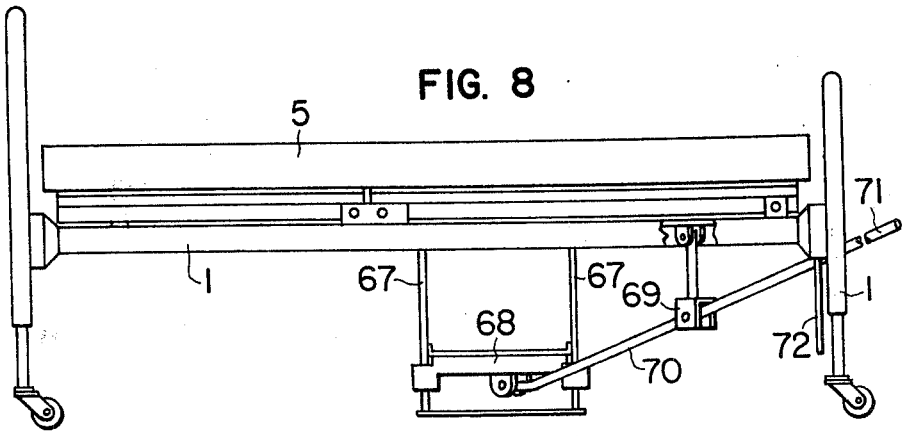
FIG. 8 is a side view of the bed for a patient showing an embodiment of means for controlling a height of the bed pan.
Figure 9:
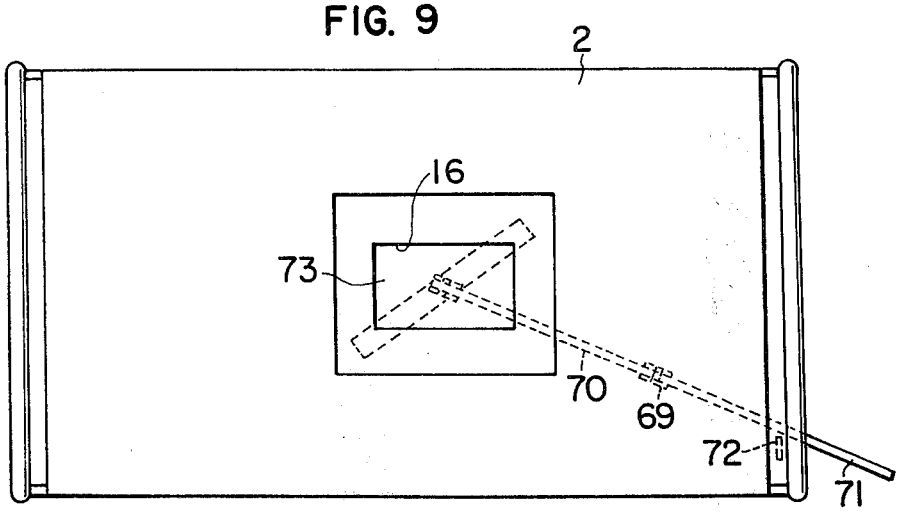
FIG. 9 is a plan view of the bed for a patient shown in FIG. 8 when viewed from above.
Figure 10:
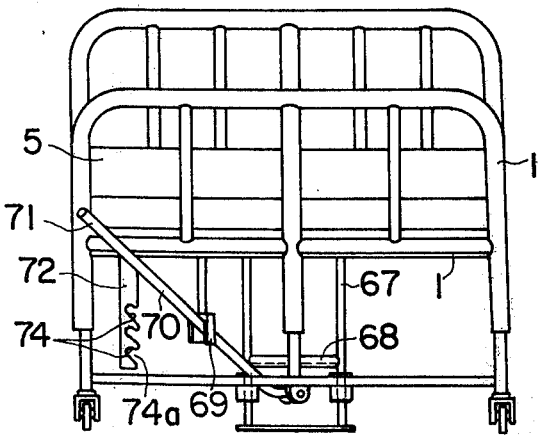
FIG. 10 is a side view of the bed for a patient shown in FIG. 8 when viewed from the side of legs of the bed.
Figure 11:
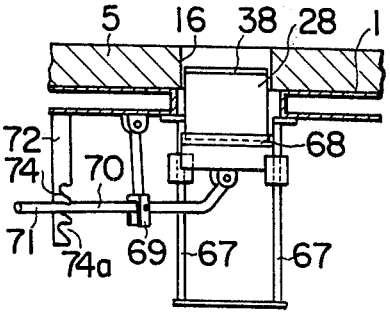
FIG. 11 is a partially vertical sectional side view of the bed for a patient shown in FIG. 8 wherein the bed pan is shown placed at a level of height such that the bed pan seat does not directly touch the buttocks of a patient but is hardly apart therefrom.
Figure 12:
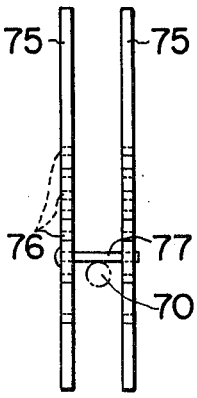
FIG. 12 is a front view of the bed for a patient shown in FIG. 8 to show another means for locking the lever for mounting the bed pan to the bed.
Figure 13:
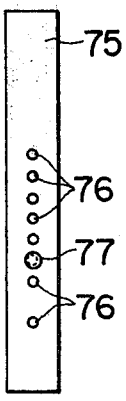
FIG. 13 is a side view of the means for locking shown in FIG. 12.

In using the present bed for an incontinent patient, the bed pan 28 is set from the beginning in such a state as shown in FIG. 6. The patient is laid down in such a manner that his buttocks are positioned right above the bed pan 28. After the front cover 39 is then fitted to the base board 47 that has been hinged 48 to the tank 37, the base board 47 is inclined in conformity with a lying position and physique of the patient whereby the right and left wall pieces 391A, 391A of the first block constituting the rising section of the front cover 39 completely encompass the groins of the patient together with its base plate 392A.

At the same time, the second and third blocks 39B and 39C to cover the skin of the patient up to the lower abdomen are bended properly so that their right and left wall pieces 391B, 391C together with the wall pieces 391D of the fourth block 39D cover the skin from the groins up to the lower abdomen in cooperation with the back plates 392B, 392C and the cover plate 392D. Thus, the covered skin of the patient from the groins up to the lower abdomen becomes into contact only with the edge plane of the wall pieces 391A through 391D whereby the excretory organ is kept free and intact from the back plate and cover plate.

When a lying posture of the patient is not optimum such as, for example, is deviated to the side of the legs of the bed, the base board 47 supporting directly the first block 39A is inclined to the side of the legs of the bed so that the first block 39A is deviated correspondingly. On the contrary when the posture is deviated to the side of the head of the bed, the handle 13 is rotated to move the connection rod 12 to the left in FIG. 1. In consequence, the levers 10, 11 are turned clockwise whereby the upper half support section 3 of the mattress support supported by the free end of the lever 10 is also rotated with the pin 7 as its fulcrum, and elevates the head side of the bed to thereby guide the deviated body to right above the bed pan 28.

In this manner, when the bed pan 28 is applied to the patient, the skin from the groins up to the lower abdomen and the buttocks of the patient are covered as if they were placed in between the front cover 39 and the pan seat 38. In accordance with the present invention, however, the pan seat 38 never touches the buttocks of the patient strongly. In other words, the length W of the bed pan mounting recess 16 in a lateral direction is determined such that when the buttocks are placed onto the recess 16, they touch the periphery 16' thereof and fall down near the lower level of the mattress 5. Because of this arrangement, when the buttocks are placed right above the recess 16 to which the bed pan 28 has been fitted, the periphery of the recess 16 becomes depressed by the weight of the patient, but the buttocks never touch the pan seat strongly.

If the periphery of the recess 16 of the mattress 5 becomes excessively depressed because of the weight of the buttocks, height of the bed pan 28 should be adjusted so that the pan seat 38 is placed at a point which is nearest the buttocks but not in contact therewith. Thus, the periphery of the pan seat 38 never presses the skin of the patient whereby it covers, in cooperation with the front cover 39, around the excretory organ of the patient in a manner as if they interpose the organ therebetween. Accordingly, the patient is always allowed to effect excretion in a stable condition without any oppressed feeling.

In the case of an incontinent patient, it is entirely unforeseen when the patient makes excretion; hence, it is advisable to replace the bed pan 28 or to dispose filth deposited therein when the filth is stored to a considerable extent in the tank 37. It is also advisable in this instance to charge a proper amount of water in the tank as a deodorant.

To withdraw the bed pan 28, the front cover 39 thereof is removed from the base board 47. Next, the handle 3 is rotated to move the bed pan truck 26 by chain driving until the bed pan 28 is transferred to a position below the rear supplementary mattress 18. After the mattress 18 and the support plate 22 thereof are withdrawn from the bed pan mounting recess 16, the bed pan 28 can then be taken out as such. The bed pan 28 thus withdrawn is covered by the lid 40, and carried to a filth treating place.

Meanwhile a fresh bed pan 28 is fitted for the incontinent patient for his accidental excretion.

The present device can be used in the following manner for a continent patient. As shown in FIG. 4, the supplementary mattress 17 and the bed pan 28 are normally placed at a waiting position below the rear supplementary mattress 18 while the bed pan 28 is being placed onto the truck 26. Only at the time of excretion of the patient, the bed pan 28 is placed in the position illustrated in FIG. 6.

Figure 5:
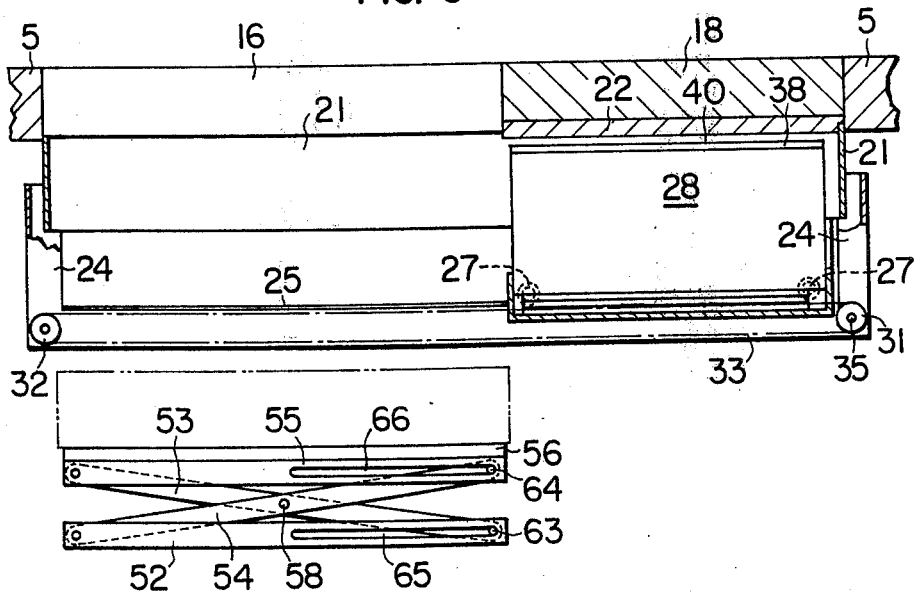
FIG. 5 is also a partially vertical sectional side view of the bed for a patient shown in FIG. 2 with the front supplementary mattress lowered.

For the patient to extrete, the handle 60 is first rotated clockwise to thereby rotate also the screw axis 61, but the connection rod 59 screwed to said axis 61 is not rotated. For this reason, the connection rod 59 is moved rightward in FIG. 1 by rotation of the screw axis 61, and the length thereof becomes shorter gradually. Accordingly, the pin 58 of the parallel crank mechanism moves rightward in FIG. 4 and transfers the pins 63, 64 provided to the movable section of the links 53, 54 along the laterally long holes 65, 66 so that the movable frame 55 descends via the links 53, 54. Hence, the front supplementary mattress 17 also descends while it being placed onto the support plate 56 of the movable frame 55. When the front supplementary mattress 17 appears perfectly below the suspension frame 24, the rotation of the handle 60 is terminated (see FIG. 5).

Next, when the handle 36 is rotated, leftward, the shaft 35 adapted to the handle integrally is rotated to cause rotation of the sprocket 31; hence, the endless chain 33 spun horizontally by the sprockets 31 32 is rotated leftward to thereby transfer the bed pan truck 26 in the same direction. As the truck 26 moves leftward in this manner, the pan 28 placed thereon also moves leftward.

When the pan 28 is guided to the position immediately below the recess 16 of the mattress 5, the front cover 39 is fitted into the concave section 46 of the base board 47 at the upper section of the tank 37, and inserted in between the groins of the patient in the same way as in the case of an incontinent patient.

After the excretion, the device is operated in the reverse way to the one described above. Namely, the front cover 39 is first removed from the tank 37, and the handle 36 is then manipulated to restore the bed pan truck 26 to the starting position. When the truck 26 restores its starting position, another handle 60 is operated to elevate the movable frame 55 until the front supplementary mattress 17 supported by the support plate 56 on the frame 55 is placed again in the recess 16 of the mattress 5. Thereafter the bed pan 28 is removed at every time of excretion or at a proper timing.

As hereinabove noted, the height of the bed pan 28 is adjusted in advance in match with the physique and weight of the patient so that the pan seat 38 never touches the buttocks of the patient strongly. Even if the bed pan 28 is kept mounted, therefore, it does not give the patient any offensive feeling, but perfectly prevents dispersion of the excrement in cooperation with the front cover 39 which comes into intimate contact with the skin of the patient ranging from the groins up to the lower abdomen and covers broadly around the excretory organ of the patient.

As the bed in accordance with the present invention employs the abovementioned insertion system of the bed pan, it does not inflict such pains on the patient as stuffiness, coarseness and the like of the skin that are usually observed in using a diaper, and always keeps the buttocks of the patient in a liberated state. Further, since the portion of the body of the patient around his coccyx does not touch the cushion or the mattress at all, the buttocks are free from the bed sore even if the bed pan 28 is always mounted to the bed.

Next, another embodiment of the invention will be explained for adjusting the height of the bed pan 28 so that the buttocks of the patient are placed to the position nearest the pan seat but not contacting the same.

FIGS. 8 through 13 represent this embodiment. As shown, the bed pan mounting recess 16 is defined in conformity with the plane shape of the bed pan 28, and a guide frame 67 having an open periphery is suspended below the recess 16. The support base 68 is adapted horizontally inside the guide frame 67 movably up and down.

A support bracket 69 is also suspended from the frame 1 to act as a supporting point, and a lever 70 is pivoted to the lower section of this bracket swingably. The one end of the lever 70 as a point of action is connected to the support base 68 while the other end as a point of force is used as a handle 71 which extends out from the frame of the bed along a guide plate 72 disposed in parallel with the bed support. Beside the lever 70 having its one end as a point of force, another type may likewise be used which has a reversed V-shape at its point of action so that said point is used as a pedal for its operation.

The support base 68 supports a supplementary mattress corresponding to the bed pan mounting recess 16, and the bed pan 28 thereon. Normally it supports said mattress 73, and during excretion, it supports the bed pan 28. Thus, the support base 68 closes the recess 16 in either case.

A plurality of lock holes 74 are bored on the guide plate 72 which is disposed in parallel with the legs of the bed, and secure the lever 70 to the guide plate 72. This arrangement keeps the buttocks of the patient at a height nearest the bed pan but not touching the same, and prevents the skin of the buttocks from touching the inside periphery of the pan seat 38 regardless of the physique of the patient.

According to this embodiment, the supplementary mattress 73 is placed on the support base 68 in a normal condition. By pushing down the lever 70 till it engages with the lowermost lock hole 74*a* of the guide plate 72, the supplementary mattress can be fitted into the bed pan mounting recess 16 so as to register the upper surface thereof with that of the mattress 5. At the time of excretion, the lever 70 is first disengaged from said lock hole 74*a*, and the handle 71 is lifted up so as to lower the support base 68 to the lowermost position. Thereafter the supplementary mattress 73 on the support base 68 is replaced with the bed pan 28.

Next, the handle 71 of the lever 70 is pushed down to elevate the support base 68, and engaged with a proper lock hole 74 other than the one at the lowermost position. Under this condition, the upper surface of the bed pan 28 is supported at a level considerably lower than that of the mattress. When the lever 70 is engaged with the uppermost lock hole, depression of the bed pan 28 becomes to its maximum.

When a continent patient or a patient infirm with age places his buttocks right above the bed pan mounting recess 16, the periphery thereof is depressed by the weight of his body. However, the lock holes 74 are properly selected in a conformity with the physique and weight of the patient such that the buttocks hardly touch the inside periphery of the pan seat 38 but are not, either apart therefrom. Hence, the buttocks do not almost touch the seat 38, and even if they do, they do not give any pain or offensive feeling to the patient.

Alternatively, the guide plate 72 having the lock holes 74 in the abovementioned embodiment may be replaced by means such as noted herebelow. Namely, an opposed pair of plates 75, 75 are suspended stably from the bed frame, and a number of holes 76 are defined on each plate at proper intervals. Thus, the lever 70 can be locked by inserting pins 77 or bolts through these holes 76 whereby it becomes possible to make a fine adjustment of the height of the bed pan 28. Accordingly, the bed pan 28 can be supported at such a level as is desired by the patient optionally.

Figure 14:
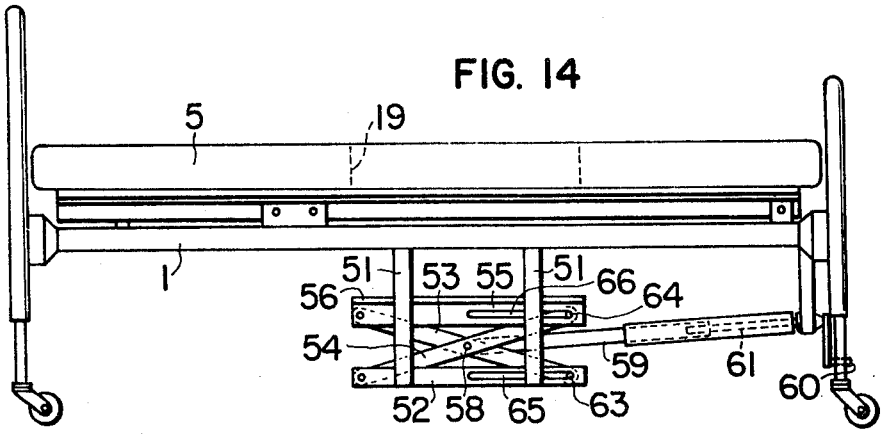
FIG. 14 is a side view of the bed for a patient wherein the mounting mechanism of the bed pan to the bed is used concurrently as an elevation mechanism of the supplementary mattresses.
Figure 15:
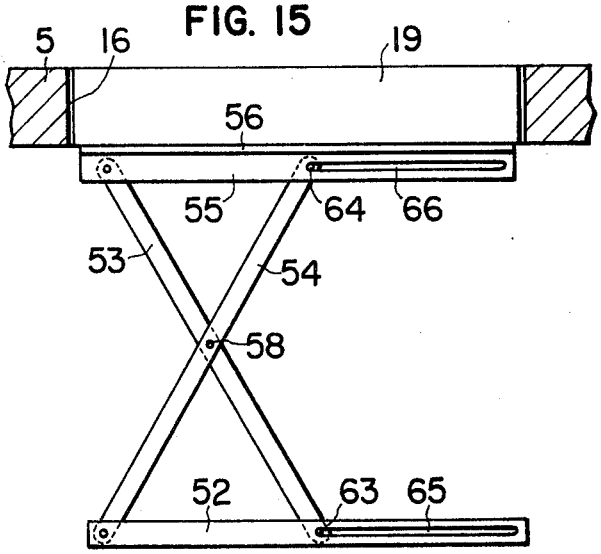
FIG. 15 is a partially vertical cross sectional side view of the bed for a patient shown in FIG. 14 wherein the bed pan mounting recess is closed up by the supplementary mattresses.
Figure 16:
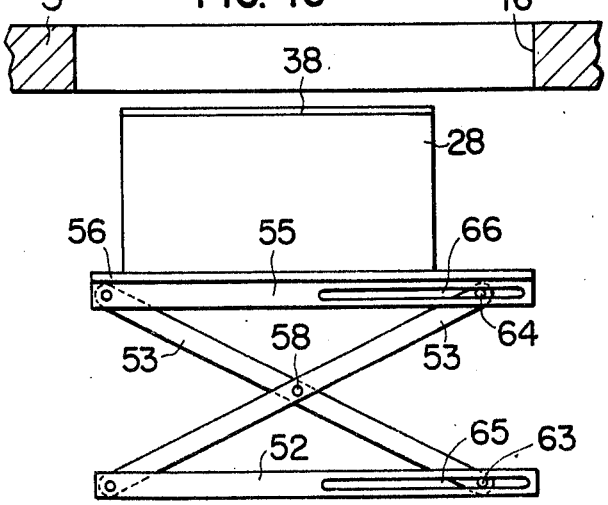
FIG. 16 is a side view of the bed for a patient shown in FIG. 14 wherein the bed pan is shown placed on a support plate after the supplementary mattresses have been removed.
Figure 17:
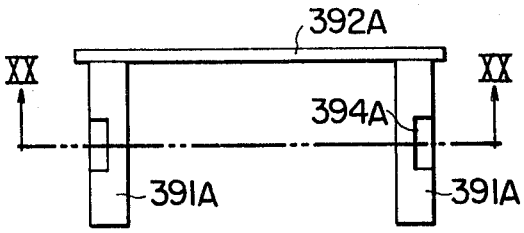
FIG. 17 is a plan view of a first blick which composes a front cover.
Figure 19:
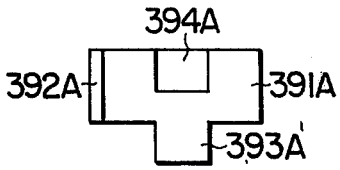
FIG. 19 is a left side view of the first block shown in FIG. 17.
Figure 18:
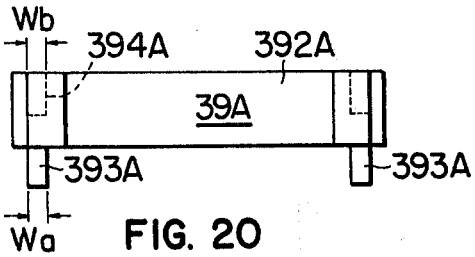
FIG. 18 is a front view of the first block shown in FIG. 17.
Figure 20:
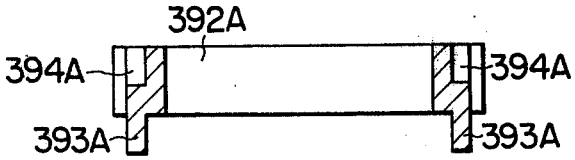
FIG. 20 is a vertical cross sectional front view of the bed taken along the line XX — XX in FIG. 17.
Figure 22:
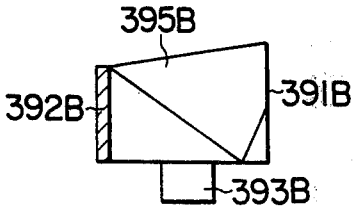
FIG. 22 is a vertical cross sectional side view taken along the line XXII — XXII in FIG. 21.
Figure 21:
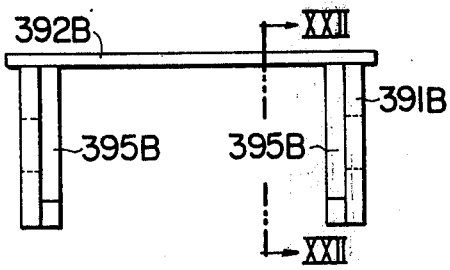
FIG. 21 is a plan view of a second block which composes the front cover.
Figure 24:
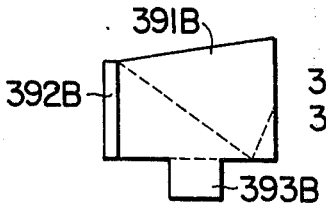
FIG. 24 is a right side view of the second block.
Figure 23:
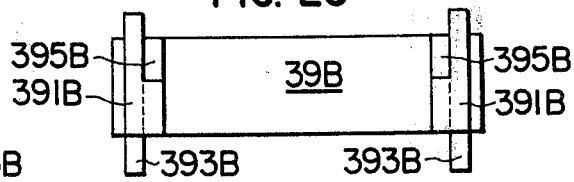
FIG. 23 is a front view of the second block.
Figure 25:
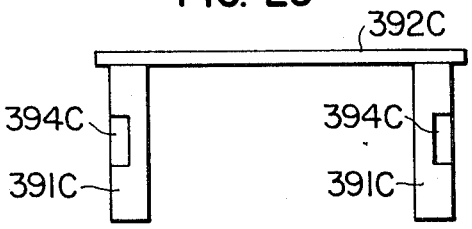
FIG. 25 is a plan view of a third block which composes the front cover.
Figure 27:
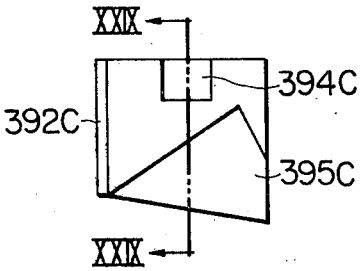
FIG. 27 is a left side view of the third block.
Figure 26:
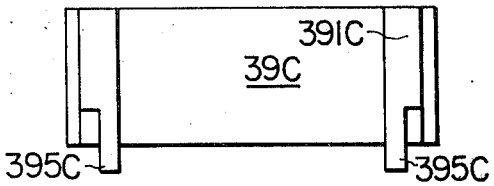
FIG. 26 is a plan view a front view of the third block.
Figure 32:
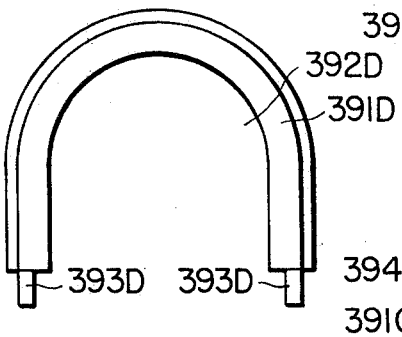
FIG. 32 is a lower end view of the fourth block.
Figure 28:
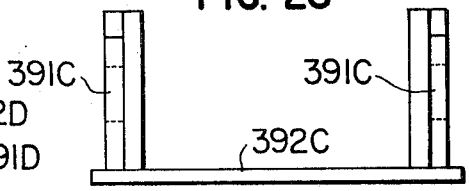
FIG. 28 is a lower bottom view of the third block.
Figure 29:
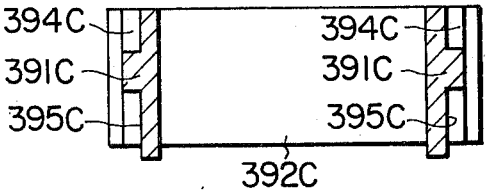
FIG. 29 is a vertical cross sectional front view of the third block taken along the line XXIX — XXIX in FIG. 27.
Figure 33:
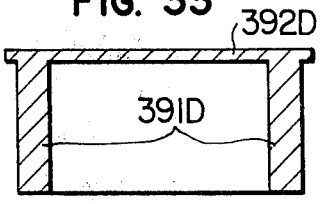
FIG. 33 is a vertical cross sectional rear view taken along the line XXXIII — XXXIII in FIG. 31.
Figure 31:
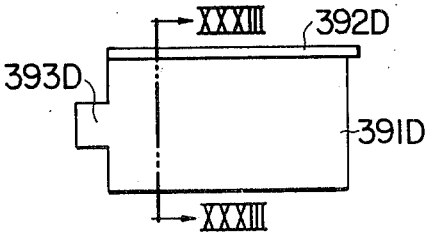
FIG. 31 is a left side view of the fourth block.
Figure 30:
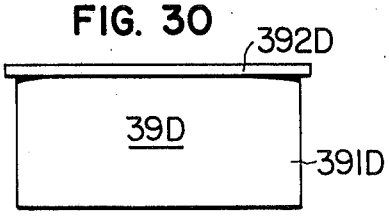
FIG. 30 is a front view of a fourth block which composes the front cover.

The supplementary mattress elevation mechanism shown in FIG. 1 can be made to act concurrently as the elevation mechanism for the bed pan 28 as illustrated in FIGS. 14 through 16. In this embodiment, the supplementary mattress 19 is placed on the support plate 56 to register its upper surface with that of the mattress 5 in a normal condition. At the time of excretion, the handle 60 is rotated to the left, and the support plate 56 is lowered by movement of respective components to be explained in the following paragraph.

That is to say, when the handle 60 is rotated, the screw axis 61 is also rotated. However, the connection rod 59 screwed to the axis 61 does not rotate, but is slid to the right in FIG. 14 and shortens its length gradually. Accordingly, the pins 63, 64 of the parallel crank mechanism are shifted in the same direction along the laterally long holes 65, 65 whereby the movable frame 55 descends by means of the links 53, 54 so as to thereby lower the supplementary mattress 19 on the support plate 56.

Next, after the supplementary mattress 19 is replaced by the bed pan 28, the handle 60 is rotated rightward whereby the length of the connection rod 59 becomes longer gradually to raise the parallel crank mechanism. In this manner the movable frame 55 is elevated, and the bed pan 28 placed on the support plate 56 is brought near the buttocks of the patient.

Operation of the handle 60 is terminated when the bed pan 28 is elevated to level such that the buttocks of the patient become nearest the inside periphery but are not touching therewith. As the bed pan 28 is brought into this condition, the periphery of the bed pan mounting recess 16 is depressed because of the weight of the patient, but the buttocks hardly touch the pan seat 38, and even if they do, only very mildly so that the patient is not given any pain or offensive feeling.

Since the bed pan 28 is mounted in the abovementioned arrangement in accordance with the present invention, the buttocks of the patient can be located at a most optimum position regardless of the shape of the pan seat 38. In other words, the present invention eliminates specific consideration for the shape thereof from the viewpoint of human engineering that has been required conventionally. Thus in accordance with the present invention, the patient can effect excretion at ease free from pain of the bed sore.

What is claimed is:

1. A bed for a patient comprising a frame, a mattress having a bed pan mounting recess provided centrally therein, a bed pan including a pan seat, tank and a hollow front cover which front cover broadly covers around the excretory organ of the patient and only the periphery of which said front cover comes into contact with the skin of the patient ranging from the groin up to the lower abdomen, and support means for supporting said bed pan at an optional height to be in conformity with a degree of depression of the periphery of said bed pan mounting recess and to keep the buttocks of the patient never strongly touching said bed pan, wherein said pan seat and said front cover are disposed in such a manner that they interpose the body of the patient therebetween.

2. A bed for a patient as claimed in claim 1, wherein said front cover of the bed pan comprises a plurality of connectable and separable blocks so that said front cover is bendable optionally at portions of specific blocks connected to each other.

3. A bed for a patient as claimed in claim 2, wherein said front cover of the bed pan is inclinable optionally both to the front and rear at its connection to said tank.

4. A bed for a patient comprising a frame, a mattress having a bed pan mounting recess provided centrally therein, a bed pan including a pan seat, tank and a hollow front cover which front cover broadly covers around the excretory organ of the patient and only the periphery of which said front cover comes into contact with the skin of the patient ranging from the groin up to the lower abdomen, and support means for supporting said bed pan at an optional height to be in conformity with a degree of depression of the periphery of said bed pan mounting recess and to keep the buttocks of the patient never strongly touching said bed pan, said support means comprising the combination of a bed pan truck which carries said bed pan thereon and is movable in a horizontal direction beneath said mattress.

5. Structure as set forth in claim 4, and further including a plurality of thin plates to be laid between said bed pan and said bed pan truck; whereby the number of said thin plates is adjusted properly to support said bed pan at a height such that the buttocks of the patient never strongly touch the bed pan seat.

6. A bed for a patient as claimed in claim 5, further including a supplementary mattress support plate which is disposed below said bed pan truck, and is movable vertically supporting a supplementary mattress thereon to close up said bed pan mounting recess formed on the mattress thereby.

7. A bed for a patient as claimed in claim 1, wherein said support means for supporting the bed pan comprises a lever mechanism which is movable vertically beneath the mattress and capable of changing a height of supporting the mattress stepwise.

8. A bed for a patient as claimed in claim 1, wherein said support means for supporting the bed pan comprises a parallel crank mechanism which is movable vertically beneath the mattress and capable of changing a height of supporting the mattress continuously.

9. A bed for a patient as claimed in claim 1, wherein the length of said bed pan mounting recess in a lateral direction of the mattress is such that the buttocks of the patient fall down to the proximity of the lower surface line of the mattress.

* * * * *